US007471799B2

(12) United States Patent
Neumann et al.

(10) Patent No.: US 7,471,799 B2
(45) Date of Patent: Dec. 30, 2008

(54) METHOD FOR NOISE REDUCTION AND MICROPHONEARRAY FOR PERFORMING NOISE REDUCTION

(75) Inventors: Joachim Neumann, Hellerup (DK); Søren Laugesen, Hellerup (DK)

(73) Assignee: Oticon A/S, Smørum (DK)

( * ) Notice: Subject to any disclaimer, the term of this patent is extended or adjusted under 35 U.S.C. 154(b) by 448 days.

(21) Appl. No.: 10/499,915

(22) PCT Filed: Jun. 21, 2002

(86) PCT No.: PCT/DK02/00422

§ 371 (c)(1), (2), (4) Date: Oct. 26, 2004

(87) PCT Pub. No.: WO03/003349

PCT Pub. Date: Jan. 9, 2003

(65) Prior Publication Data

US 2005/0063558 A1 Mar. 24, 2005

(30) Foreign Application Priority Data

Jun. 28, 2001 (DK) ..... 2001 01015

(51) Int. Cl.
*H04R 25/00* (2006.01)

(52) U.S. Cl. ..... 381/317; 381/313

(58) Field of Classification Search ..... 381/23.1, 381/71.6, 92, 94.1, 94.3, 312, 316, 317, 321, 381/71.11, 73.1

See application file for complete search history.

(56) References Cited

U.S. PATENT DOCUMENTS

| | | | | |
|---|---|---|---|---|
| 4,366,349 | A * | 12/1982 | Adelman | 381/316 |
| 4,622,440 | A * | 11/1986 | Slavin | 381/312 |
| 4,956,867 | A * | 9/1990 | Zurek et al. | 381/71.11 |
| 5,027,410 | A | 6/1991 | Williamson et al. | 381/320 |
| 5,825,898 | A | 10/1998 | Marash | 381/92 |
| 6,178,248 | B1 | 1/2001 | Marash | 381/94.7 |
| 6,363,345 | B1 | 3/2002 | Marash et al. | 704/226 |
| 6,408,318 | B1 | 6/2002 | Fang et al. | 708/313 |
| 6,987,856 | B1 * | 1/2006 | Feng et al. | 381/92 |
| 7,031,478 | B2 * | 4/2006 | Belt et al. | 381/92 |

FOREIGN PATENT DOCUMENTS

| | | |
|---|---|---|
| EP | 883325 | 12/1998 |
| WO | 8302212 | 6/1983 |
| WO | 9921400 | 4/1999 |
| WO | 0049602 | 8/2000 |
| WO | 0060739 | 10/2000 |
| WO | 0152242 | 7/2001 |

* cited by examiner

*Primary Examiner*—Brian Ensey
(74) *Attorney, Agent, or Firm*—Dykema Gossett PLLC

(57) ABSTRACT

Method of noise reduction in a hearing aid or a listening device to be used by a hearing impaired person in which the noise reduction is provided primarily in the frequency range wherein the hearing impaired has the smallest hearing loss or the best hearing.

7 Claims, 6 Drawing Sheets

METHOD FOR NOISE REDUCTION AND MICROPHONEARRAY FOR PERFORMING NOISE REDUCTION

AREA OF THE INVENTION

The invention relates to a method for noise reduction in which the noise reduction is tailored to the hearing loss of the hearing impaired person. The invention further relates to a microphone array for performing noise reduction.

BACKGROUND OF THE INVENTION

Modern hearing aids are often provided with some sort of noise reduction scheme based on directionality or signal processing blocking out noise signals. Also in other assistive listening devices such as hand held microphone systems noise reduction is often utilized.

With regard to the invention it is important to distinguish between noise reduction algorithms that apply to a single sensor signal and noise reduction systems that employ two or more sensor signals.

The former category of noise reduction algorithms exploits the fact that a speech signal has certain distinct characteristics that are different from the characteristics of most noise signals. Hence, if the noise is speech-like (other voices, for example) the noise reduction algorithm will have no effect. Also they are characterized by dividing the input signal into a number of frequency bands. In each frequency band, an estimate of the modulation index (or something similar) is used to predict whether there is useful speech information available in that band, or whether the band is dominated by noise. In bands dominated by noise the gain is reduced. It is clear that in each frequency band it is impossible to improve neither the local Signal to Noise Ratio (SNR) nor the local Speech Intelligibility (SI). Thus, the algorithm can only improve the global SNR/SI by attenuating bands with so much noise that they mask out the useful speech information in other bands. Accordingly, such noise reduction algorithms that have been implemented in hearing aids have not been able to provide systematic improvements of SI, but only improved listening comfort (Boymans, M., W. A. Dreschler, P. Schoneveld & H. Verschuure, 1999, "Clinical evaluation of a fully-digital in-the-ear hearing instrument", Audiology 38(2), p. 99-108. Boymans, M. & W. A. Dreschler, 2000, "Field trials using a digital hearing aid with active noise reduction and dual-microphone directionality", Audiology 39(5), p. 260-268. Gabriel. B., 2001, "Nutzen moderner Hörgeräte-Features für Hörgeräte-Träger am Beispiel eines speziellen Hörgeräte-Typs", Z. Audiol. 40(1), p. 16-31. Valente, M., D. Fabry, L. Potts & R. Sandlin, 1998, "Comparing the performance of the Widex Senso digital hearing aid with analog hearing aids", Journ. Am. Acad. Audiol. 9(5), p. 342-360. Walden, B E., R K. Surr, M T. Cord, B. Edwards & L. Olson, 2000, "Comparison of benefits provided by different hearing aid technologies", Journ. Am. Acad. Audiol. 11, p. 540-560.).

In contrast, noise reduction systems that employ two or more sensor signals exploit the spatial differences between the target and noise sources. By combining these input signals it is possible to remove signal contributions impinging from non-target directions, which means that both SNR and SI can be improved both locally and globally in the frequency range of operation (Killion, M., R. Schulein, L. Christensen, D. Fabry, L. Revitt, P. Niquette & K. Ching, 1998, "Real-world performance of an ITE directional microphone", The Hearing Journal, 51(4). Soede, W., F. A. Bilsen & A. J. Berkhout, 1993, "Assessment of a directional microphone array for hearing-impaired listeners", J. Acoust. Soc. Am. 94(2), p. 799-808.). The present invention regards only the latter category of noise reduction systems.

The signal processing in noise reduction systems which are based on directionality can be either fixed-weight or adaptive. In a fixed-weight system, the directional pattern is designed once and for all, based on some assumptions on the nature of the typical noise sound field, e.g. that the noise sound field is diffuse. In an adaptive system, the directional pattern is adjusted online according to some optimization scheme. Either way, such noise reduction systems have so far been designed to function over a broad frequency range, and in the signal processing unit of the hearing aid the output signal is subjected to a certain amount of amplification, which is determined according to the hearing loss of the individual carrying the hearing aid.

An example of a traditional way of realizing an adaptive beamforming is given in U.S. Pat. No. 4,956,867 and in WO 00/30404 where equal priority is given to all frequencies.

While these two examples consider broadside arrays, an adaptive endfire array is disclosed in U.S. Pat. No. 6,154,552.

It has not hitherto been suggested to tailor the noise reduction to the hearing loss of the individual and no methods for doing so have been proposed.

In a study by Saunders G H and Kates J M published in 1997 in an article in "Journal of the Acoustical Society of America" 102:3; 1827-1837 the performance of directional systems used by hearing impaired subjects are compared. In the study Saunders and Kates ran a series of speech reception threshold and speech intelligibility rating experiments with eighteen hearing impaired subjects with symmetrical sloping hearing loss. They processed separately recorded microphone signals from five microphones in an equally spaced 11-cm endfire configuration. The signals were recorded in an office room and a (more reverberant) conference room and processed off-line in two directional array systems (delay-and-sum and superdirective). The two arrays were compared to a cardioid and an omnidirectional microphone.

FIG. 1 shows the result of speech intelligibility tests for hearing impaired subjects in eight situations wherein two directional alaorithms, i.e., delay-and-sum (DAS) and superdirective (SUP). were tested against a cardioid (CAR) and an omni-directional microphone (OMN). The figure demonstrates that the superdirective system (SUP) performed best in both listening situations (office and conference room). However, contrary to the authors' expectations, the delay-and-sum (DAS) performed worse than a single cardloid microphone (CAR), although the directivity index of the cardioid microphone when weighted with the articulation index (AI-DI) was inferior.

Saunders and Kates pointed out that at low frequencies, the directionality of a cardioid microphone is better than the directionality of the delay-and-sum array. They speculated that their surprising result could be explained by the speech power, which is concentrated at low frequencies. This is however inconsistent with the articulation index importance function, which shows dominance at higher frequencies as seen in FIG. 2.

On the basis of the results from the above study it is not clear how a noise reduction should be tailored to give the most benefit for a particular kind of hearing loss.

An object of the invention is to provide a method of tailoring noise reduction to the individual hearing impaired person, such that maximum benefit of the noise reduction is obtained for the hearing impaired.

A further object of the invention is to provide a hearing aid or a listening device suited to perform a noise reduction tailored to the hearing loss of the individual using the device.

SUMMARY OF THE INVENTION

The object of the invention is achieved in a method of noise reduction in a hearing aid or listening device to be used by a hearing impaired person whereby signals are received from two or more microphones wherein the noise reduction is provided primarily in the frequency range wherein the hearing impaired has the smallest hearing loss and the best hearing.

In an embodiment the method comprises the steps of receiving signals from an array of microphones and processing the signals in a signal processing unit whereby the noise reduction is achieved through beamforming of the signals from some or all of the microphones and whereby the number of microphones and their spacing is such that the highest directivity is provided in the frequency range wherein the hearing impaired has the smallest hearing loss.

The microphone arrays may comprise an endfire array, a broadside array or combinations thereof.

In this method the signal processing unit may retrieve the signal from a given subset of microphones, which forms an array that facilitates beamforming with the highest directivity index in the frequency range wherein the hearing impaired has the best heading.

In a further embodiment the method comprises the steps of receiving signals from an array of microphones and processing the signals in a signal processing unit such that a noise reduction is achieved through adaptive beamforming of the signal from some or all of the microphones, whereby the directivity is optimized according to the acoustical environment in such a way that the highest priority is given to the frequency range, wherein the hearing impaired has the smallest hearing loss.

The advantages of adaptive beamforming is well known, and by combining the adaptive beamforming with the inventive concept of providing the highest priority to the frequency range wherein the hearing impaired has the best hearing, it is ensured that the hearing impaired benefits the most from the signal processing under all circumstances.

The invention further concerns a hearing aid or listening device to be used by a hearing impaired person, wherein a noise reduction is performed. The hearing aid or the listening device comprises at least one array of microphones and a signal processing unit where a noise reduction is achieved through fixed-weight beamforming of the signals from at least two of the microphones, so that the signals from the microphones are processed by the signal processing unit in order to provide an output signal from which the noise predominantly has been removed from the frequency range, wherein the user has the smallest hearing loss.

The device may have an endfire or broadside array or combinations thereof, so that different beamforming schemes may be realized in the signal processing unit by processing the signals from a given subset of microphones.

In an embodiment of the device the hearing aid or listening device comprises an endfire array with a at least six microphones 1, 2, 3, 4, 5, 6 arranged such that the spacing between microphones 1, 2, 3, 4 and 5 is d and the spacing between microphones 5 and 6 is two times d, and wherein the signal processing unit has at least 4 input channels, and whereby the signal processing unit is arranged to either retrieve the signal from microphones 1, 2, 3 and 4 or to retrieve the signal from microphones 1, 3, 5 and 6.

By this device a high directivity index may be achieved in a low frequency range by retrieving the signals from the subset of microphones with the spacing of two times d, and a high directivity index in a high frequency range may be achieved by retrieving the signals from the subset of microphone with the spacing of d. In this way the device can deliver a noise reduction which is tailored to the hearing loss of the individual using the device.

A further embodiment of the device can be realized as a part of an adaptive noise canceller where a fixed linear filter with a magnitude response that reflects the hearing loss of the individual is implemented as part of the adaptive noise canceller.

DESCRIPTION OF A PREFERRED EMBODIMENT

Figure 1:
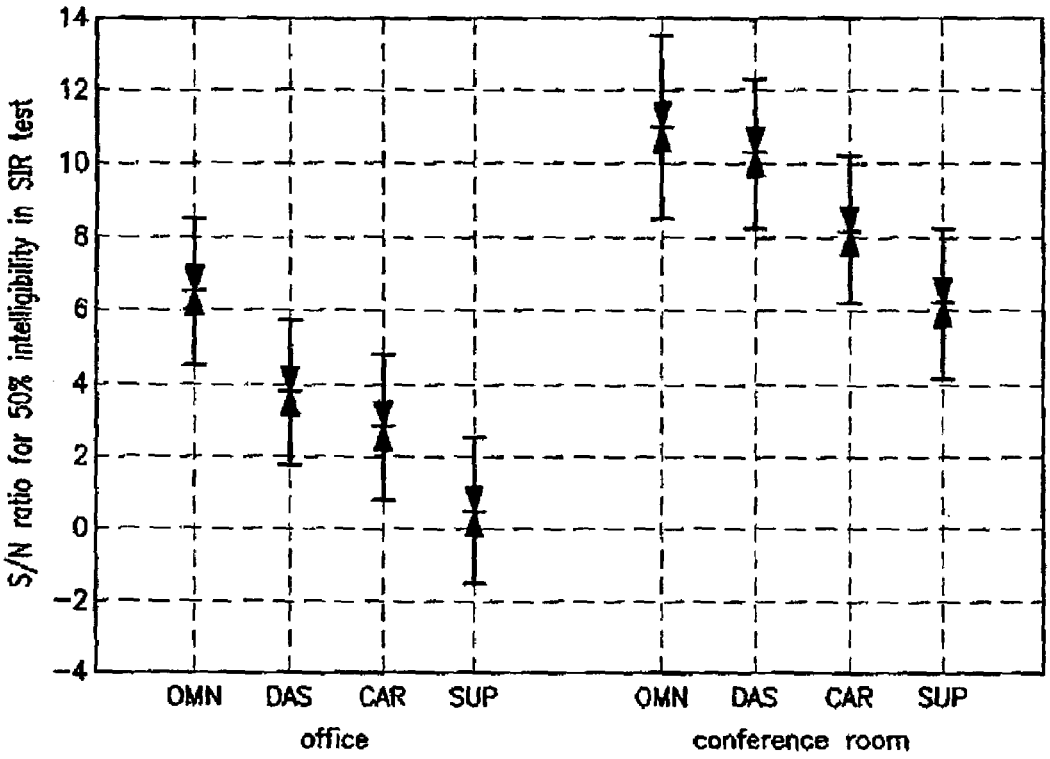
FIG. 1 PRIOR ART
FIG. 1 is a comparison of the signal-to-noise ratio for 50% intelligibility for hearing impaired subjects in a speech intelligibility rating experiment of the prior art.
Figure 2:
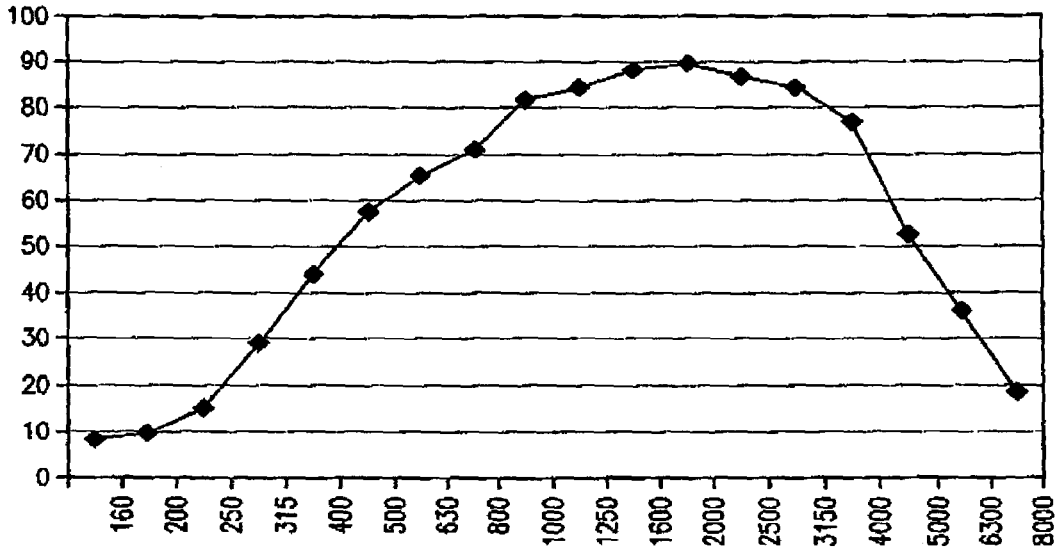
FIG. 2 PRIOR ART
FIG. 2 shows values of articulation index importance function for average speech at ⅓-octave center frequencies from the prior art (Pavlocic, 1987), wherein the sum of the AI importance values is 1000.
Figure 3A:
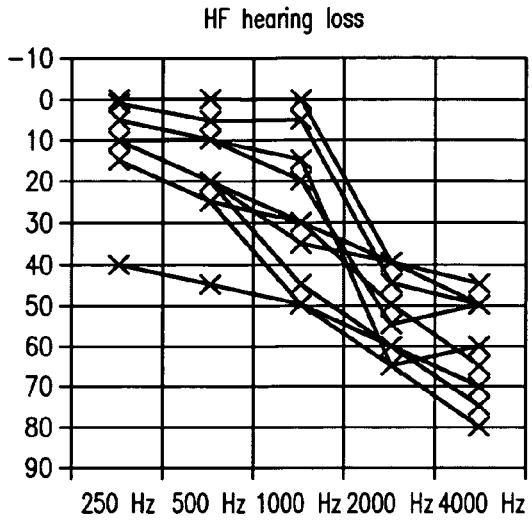
FIGS. 3*a*, 3*b*, 3*c* show audiograms of the subjects in the experiments of the present inventors, FIG. 3*a* involving subjects with high frequency hearing loss, FIG. 3*b* involving subjects with a flat hearing loss, and FIG. 3*c* involving subjects with inverse sloping hearing loss.
Figure 3B:
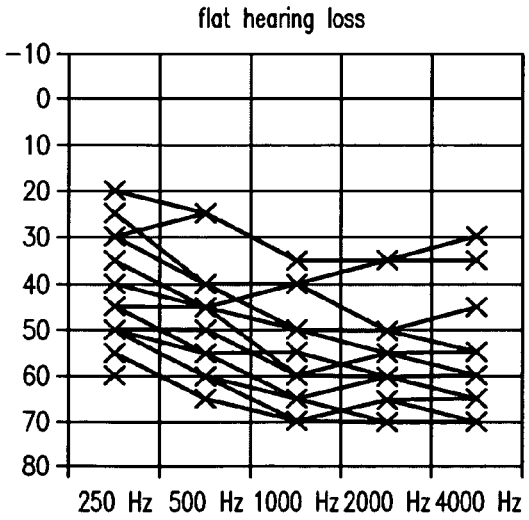
Figure 3C:
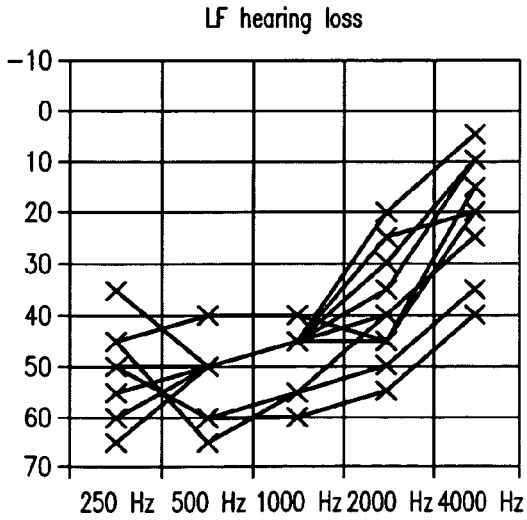

In order to clarify the possibilities tailoring (spectral shaping) noise reduction to hearing loss, a speech intelligibility experiment with hearing impaired subjects was designed. In the experiment, the noise signal 10 in a speech intelligibility test was reduced in level and spectrally shaped 11. These noise reduction strategies simulate the effect of noise reduction by directional systems in a spatial listening situation. The study included 21 subjects with almost the same number of ears with a flat hearing loss, an inverse sloping loss and sloping high frequency hearing loss. Only subjects with moderate to severe losses were chosen. FIGS. 3*a*-3*c* show the audiograms of the subjects in the three groups.

Figure 4:
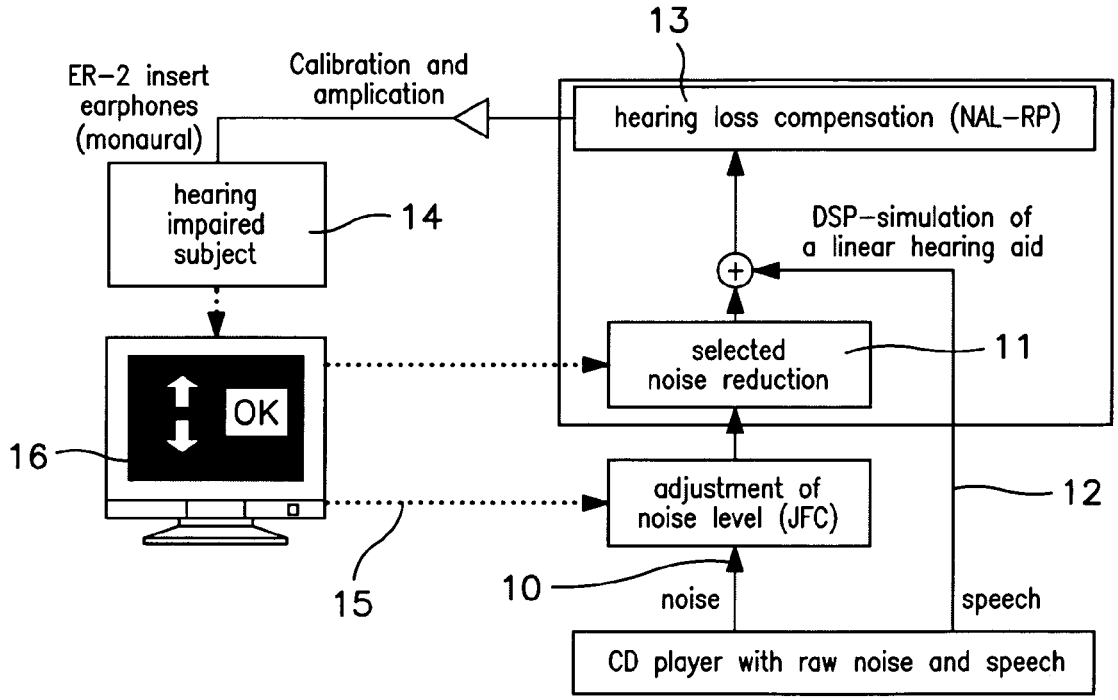
FIG. 4 shows the experimental setup used in the study of the present invention.

The experimental setup is sketched in FIG. 4. The unfiltered raw speech signal 12 and the speech shaped noise signal were recorded. The noise reduction, compensation of hearing loss and JFC speech intelligibility test is described in the following sections.

The noise signal was filtered 11 prior to presentation to the subject in order to emulate three different noise reduction strategies. The transfer functions of these filters 11 are shown in FIG. 5.

Figure 5:
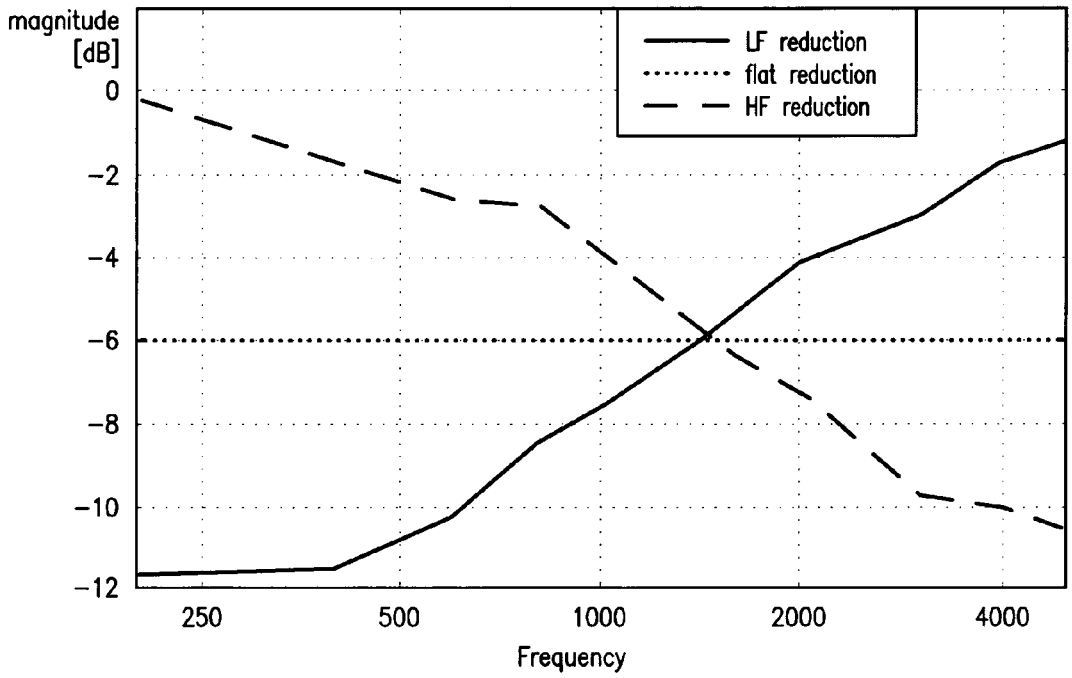
FIG. 5 depicts three noise reduction strategies according to the invention.

In FIG. 5 the dotted line at −6 dB represents a flat noise reduction system that equally reduces the noise level at all frequencies. The other two reduction strategies were realized as FIR filters. The two thick lines represent noise reduction primarily at low frequencies (thick solid line) and primarily at high frequencies (thick dashed line), respectively.

The raw noise signal was chosen to match the long-term spectrum of the speech (ICRA CD, unmodulated speech shaped noise, male speaker). The noise reduction strategies were simulated by filtering the noise signal before adding speech 12.

Hearing Loss Compensation.

Hearing loss compensation (setting of insertion gain of the simulated hearing aid 13) is done after noise reduction. This corresponds the best to a real life situation of a hearing impaired person who uses some sort of assistive listening device in combination with his usual hearing aid. The amplification was based on the individual audiogram according to the NAL-RP fitting rationale (Macrae J. H. and Dillon H: Journal of rehabilitation research and development 33:4, 363-376).

The JFC Test.

The purpose of the speech intelligibility testing is to have hearing-impaired subjects 14 evaluate the effectiveness of the three noise reduction strategies. This was achieved by allowing the test subjects to adjust the level of the noise signal 15 while the level of the speech signal was constant throughout the experiment. The change in the SNR in the input signal was realized before the noise reduction system. The task of the subjects was to adjust the noise level until they could just follow and understand the speech signal (the JFC or just follow conversation level).

The speech signal presented to the subjects was a recording of a male speaker reading from a novel. The subjects were briefly introduced to the task as well as to the computer screen 16 and the PC mouse that allowed hem to adjust the level of the noise signal in order to achieve a signal-to-noise ratio, in which they could just follow the speech signal. In the monaural presentation, the subjects were asked to adjust the noise four times per ear.

Results.

The subjects were grouped according to their hearing loss: inverse sloping hearing loss, flat hearing loss and high frequency hearing loss.

A JFC-level of 0 corresponds to a SNR of 0 dB, and higher JFC-levels correspond to a negative SNR (the subjects can tolerate more noise, and still follow the conversation).

Table 1 outlines the mean and standard deviation of the JFC-levels for each of the three subgroups with HF, LF and flat hearing loss as well as the whole population. The levels for the flat noise reduction is used as reference and set to 0 dB to exclude the effect of different JFC criteria used by the individual subjects.

TABLE 1

Mean and standard deviations of the "normalized JFC-levels. The JFC-levels for the flat noise reduction are set to 0 dB to exclude the effect of inter-individual differences on the JFC criteria.

| | Whole population | | HF loss subgroup | |
|---|---|---|---|---|
| | # ears | 42 | # ears | 13 |
| | mean | std.dev | mean | std.dev |
| LF reduction | −0.3 | 1.8 | 0.3 | 0.9 |
| flat reduction | 0.0 | 0.0 | 0.0 | 0.0 |
| HF reduction | −0.8 | 1.9 | −2.1 | 1.5 |
| | LF loss subgroup | | flat loss subgroup | |
| | # ears | 12 | # ears | 17 |
| | mean | std.dev | mean | std.dev |
| LF reduction | −1.0 | 2.2 | −0.3 | 2.0 |
| flat reduction | 0.0 | 0.0 | 0.0 | 0.0 |
| HF reduction | 0.7 | 2.1 | −0.9 | 1.1 |

In the group of high frequency hearing losses, the LF noise reduction provides a 2.4 dB benefit in comparison to HF noise reduction. Statistical analysis shows that subjects with a low frequency hearing loss prefer HF noise reduction and they can tolerate 1.7 dB more noise than in the case of LF noise reduction. Subjects with flat hearing loss show a slight tendency toward better performance with flat noise reduction. Both these results were statistically significant.

Conclusion.

The study shows that hearing impaired subjects benefit more from noise reduction in the frequency region of their best hearing than they benefit from a noise reduction in other frequency regions. This is confirmed for subjects with high frequency hearing loss as well as for subjects with inverse sloping hearing loss.

Figure 6:
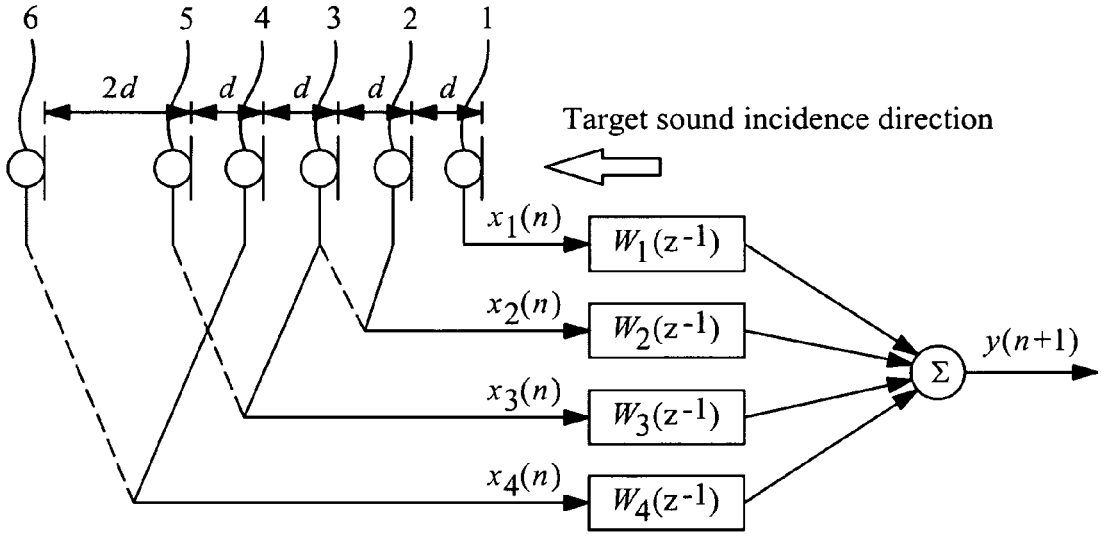
FIG. 6 shows an endfire array of microphones.

An example of a device, which can be configured to perform the desired tailoring of the noise reduction will now be described with reference to FIG. 6, which shows an endfire array with a total of 6 microphones 1, 2, 3, 4, 5, 6. The spacing between microphones 1, 2, 3, 4 and 5 is d and the spacing between microphones 5 and 6 is two times d. Assume a fixed number of 4 input channels to the signal processing unit is available. By retrieving the digitized signals $x_1(n)$, $x_2(n)$, $x_3(n)$, $x_4(n)$ from microphones 1, 2, 3, 4 an array having a microphone spacing d is achieved. By retrieving the signals from microphones 1, 3, 5 and 6 an array having a microphone spacing ot two times d is achieved.

An array having a microphone spacing of two times d would be suited to provide high directivity in the low frequency area, and accordingly this array would be best suited for a sloping high frequency hearing loss.

An array having a microphone spacing of d would be suited to provide high directivity in the high frequency area, and accordingly this array would be best suited for an inverse sloping low frequency hearing loss.

In each case the filters $W_{1\text{-}4}(z^{-1})$ has to be optimized for the task of beamforming within the prescribed frequency range.

The invention claimed is:

1. Method of noise reduction in a hearing aid or listening device to be used by a hearing impaired person having a certain frequency range of smallest hearing loss and best hearing whereby signals are received from two or more microphones and wherein noise reduction is provided with highest directivity in said frequency range.

2. Method as claimed in claim 1, including the steps of receiving signals from an array of microphones and processing the signals in a signal processing unit whereby the noise reduction is achieved through beamforming of the signals from some or all of the microphones and whereby the number of microphones and their spacing is such that the highest directivity is provided in said frequency range.

3. Method as claimed in claim 1, including the steps of receiving signals from an array of microphones and processing the signals in a signal processing unit such that a noise reduction is achieved through adaptive beamforming of the signal from some or all of the microphones, whereby the directivity is optimized according to the acoustical environment in such a way that the highest priority is given to said frequency range.

4. Hearing aid or listening device to be used by a hearing impaired person having a frequency range of smallest hearing loss and best hearing and wherein a noise reduction is performed whereby the hearing aid or the listening device comprises at least one array of microphones and a signal processing unit where a noise reduction is achieved through beamforming of signals from at least two of the microphones, so that the signals from the microphones are processed by the signal processing unit in order to provide an output signal from which the noise predominantly has been removed from said frequency range.

5. Hearing aid or listening device as claimed in claim 4, wherein the device comprises an endfire array with at least six microphones 1, 2, 3, 4, 5, 6 arranged such that a spacing between the microphones 1, 2, 3, 4 and 5 is d and a spacing between microphones 5 and 6 is two times d, wherein the signal processing unit has at least 4 input channels, and whereby the signal processing unit is arranged to either retrieve the signal from microphones 1, 2, 3 and 4 or to retrieve the signal from microphones 1, 3, 5 and 6.

6. Hearing aid or listening device as claimed in claim 4 whereby the device comprises an adaptive noise canceller where a fixed linear filter with a magnitude response that reflects the hearing loss of the individual is implemented as part of the adaptive noise canceller.

7. A method of noise reduction in a hearing aid or listening device used by a hearing impaired person having a predetermined frequency range of smallest hearing loss and best hearing, comprising the steps of emitting signals from at least two microphones towards the hearing aid or listening device, and focusing noise reduction in the hearing aid or listening device in said frequency range.

* * * * *